US008181572B2

(12) United States Patent
Van Denend

(10) Patent No.: US 8,181,572 B2
(45) Date of Patent: May 22, 2012

(54) SYSTEM AND METHOD FOR MATCHING A CORRECTED SLEEVE TO A SUBSTRATE PRINTING CYLINDER

(76) Inventor: Mark Van Denend, Paterson, NJ (US)

( * ) Notice: Subject to any disclaimer, the term of this patent is extended or adjusted under 35 U.S.C. 154(b) by 511 days.

(21) Appl. No.: 12/335,384

(22) Filed: Dec. 15, 2008

(65) Prior Publication Data

US 2010/0147170 A1 Jun. 17, 2010

(51) Int. Cl.
*B41F 27/00* (2006.01)
*B41L 3/02* (2006.01)
*B41L 3/08* (2006.01)

(52) U.S. Cl. ..... 101/382.1; 101/486

(58) Field of Classification Search ..... 101/382.1, 101/376, 486
See application file for complete search history.

(56) References Cited

U.S. PATENT DOCUMENTS

| | | | | |
|---|---|---|---|---|
| 6,377,772 | B1 | 4/2002 | Chowdry | |
| 6,691,614 | B2 | 2/2004 | Bell | |
| 6,792,857 | B2 * | 9/2004 | Sameit et al. | 101/375 |
| 7,011,022 | B2 | 3/2006 | Motard | |
| 7,055,428 | B2 | 6/2006 | Schaschek | |
| 7,171,901 | B2 | 2/2007 | Salvestro | |
| 7,284,484 | B2 * | 10/2007 | Van Denend | 101/467 |
| 7,308,854 | B2 | 12/2007 | Rossini | |
| 2007/0125254 | A1 * | 6/2007 | Gartner | 101/485 |
| 2007/0181024 | A1 | 8/2007 | Tabuchi | |
| 2008/0011173 | A1 * | 1/2008 | Rossini et al. | 101/368 |
| 2008/0105149 | A1 | 5/2008 | Rogge | |

* cited by examiner

*Primary Examiner* — Judy Nguyen
*Assistant Examiner* — Blake A Tankersley
(74) *Attorney, Agent, or Firm* — Lawrence Lambelet

(57) ABSTRACT

A system and method of identifying the match of a printing cylinder and sleeve when the combination thereof has been dressed by laser ablation to achieve a degree of cylindricity. It is desirable to retain the identification of this match for reuse purposes and thereby avoid unnecessary redressing. The identification convention of the invention represents simple encoding, conventional marking means, and readability on sight.

8 Claims, 3 Drawing Sheets

SYSTEM AND METHOD FOR MATCHING A CORRECTED SLEEVE TO A SUBSTRATE PRINTING CYLINDER

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

1. Field of the Invention

The field of the present invention is printing. More particularly, the field of the present invention is preparing cylinders and sleeves mounted thereon for optimum cylindricity and marking the relationship therebetween for the benefit of matching in future use scenarios.

2. Description of Related Art

It is well-known that printing plates or printing sleeves are mounted on cylinders in a printing operation. The cylinders can include one or more sleeves or other layers thereon. The printing plates are etched or engraved in accordance with a desired image in order to effect the printing operation. It is also known that such etching or engraving of the image on the printing plate can be accomplished by means of a laser.

Typically, a printing press has a set of cylinders, or built-up mandrels, which are used to increase the diameter of the mandrel in the press. Sleeves corresponding to a plate repeat are mounted onto the cylinder. In the case of a printing sleeve, the sleeve itself is imaged as the plate. A typical printing operation for a 10-color press may have three to six sets of cylinders and 100 to 500 sleeves with inner diameters that correspond to the sets of cylinders. The outer diameter corresponds to the print repeat desired.

However, a problem with such known arrangements is that the raised surface of the printing plate, when mounted on the cylinders and sleeves, is not adequately cylindrical. In other words, apart from the etched portions, there are variations in the radii at different positions of the raised surface of the printing plate, measured from the center of the cylinder to the raised surface of the printing plate, thereby providing variations in the cylindricity.

U.S. Pat. No. 7,284,484 to the instant inventor, incorporated herein by reference, describes a method and product to improve the cylindricity of a combination of cylinder and sleeve by laser ablation. This is achieved by a system in which a control device, receiving data on variations in total indicated run-out (TIR) and taper from a detector, instructs a laser in the ablative correction of the sleeve surface to remove the variations through rotational and lengthwise translational movement relative to the sleeve.

While the method is effective in correcting the printing package, a problem exists in the logistics of matching the components of cylinder, sleeve and plate, or printing sleeve, and storing them for reuse. An identification system is needed to restore the unique match of components, thereby to perpetuate the improvement and save costly regeneration of cylindricity.

German patent DE 297 20 298 discloses a printing sleeve for a flexographic printing machine in whose envelope surface an electronic memory module configured as a transponder is introduced for the purpose of identification. Similarly, U.S. Pat. No. 7,308,854 to Rossini discloses an embeddable, activatable, signaling device that stores characterization data. Also, U.S. Pat. No. 6,377,772 to Chowdry discloses an indicia for identification purposes on the sleeve of a cylinder of an electrostatographic machine.

While all of these prior art devices can record, or represent, data, they all require an electronic reader or scanner to interpret the stored information. The recording and reading sophistication of such devices exceeds the simple needs of matching components and introduces unnecessary costs when the storage and cross-referencing of a multiplicity of data is not required. Further, the press operator must carry, or otherwise consult, an electronic display to identify compatible components when a simple visual identification means would suffice. What is needed is a simple marking convention that gives immediate visual recognition to a proper match of components and can be easily and simply applied without embedding electronically-readable assets.

BRIEF SUMMARY OF THE INVENTION

In view of the above-mentioned unfulfilled needs in the prior art, the present invention embodies, but is not limited by, the following objects and advantages:

A first object of the present invention is to provide a means for identifying a relationship between a sleeve, or a printing sleeve, and a cylinder the combination of which has undergone a customization process specific to the combination.

A second object of the present invention is to provide a visual means for recognizing the means for identifying without the aid of reading equipment.

A third object of the present invention is to provide an efficient means for applying the means for identifying to the components thereby related.

The preferred embodiment of the present invention is a marking convention wherein any cylinder is identified by an outside diameter and a number uniquely indicating one of several cylinders of the same diameter. The marking convention is further comprised of the outside diameter of a sleeve fitted to the cylinder for the purposes of cylindricity dressing by laser ablation combined with a number uniquely indicating one of several sleeves of the same diameter. For example, the identification code, C4.25-1-S4.75-5, identifies the 5th 4.75" diameter sleeve matched to the 1st 4.25" diameter cylinder.

Another aspect of the preferred embodiment is the means by which the marking convention can be applied to the sleeve. The marking convention can preferably be etched on the sleeve surface by the laser following an ablation session. This provides an immediate process which avoids subsequent steps, and ensures the replacement of any indicia previously placed which is removed by erosion in the current session.

In a second embodiment of the present invention, the marking convention herein described can be applied in identical manner and means to a printing sleeve.

A third embodiment of the present invention represents a method of identifying a unique relationship between a cylinder and a sleeve fitted thereto for the purposes of laser ablating a cylindricity correction. The method comprises the steps of marking a cylinder with a convention providing a unique identification thereto, mounting a sleeve having a compatible inside diameter and an outside diameter appropriate to the repeat length of a chosen printing plate to the cylinder, measuring the variability cylindricity of the mounted sleeve with respect to cylindricity, laser ablating the sleeve to achieve desired tolerances, marking the sleeve with a unique identification relating the sleeve and cylinder, and repeating the process for each new cylinder and sleeve combination.

The embodiments and objects herein described are illustrative and not intended to be exhaustive. Other versions, methods and devices can be realized by a person having ordinary skill in the art through insightful reflection and through the practice of the present invention.

BRIEF DESCRIPTION OF THE SEVERAL VIEWS OF THE DRAWING(S)

Various other objects, features and attendant advantages of the present invention will become fully appreciated through consideration of the accompanying drawings and the detailed description following, in which like reference characters designate the same or similar parts throughout the several views, and wherein.

DETAILED DESCRIPTION OF THE INVENTION

Figure 1:
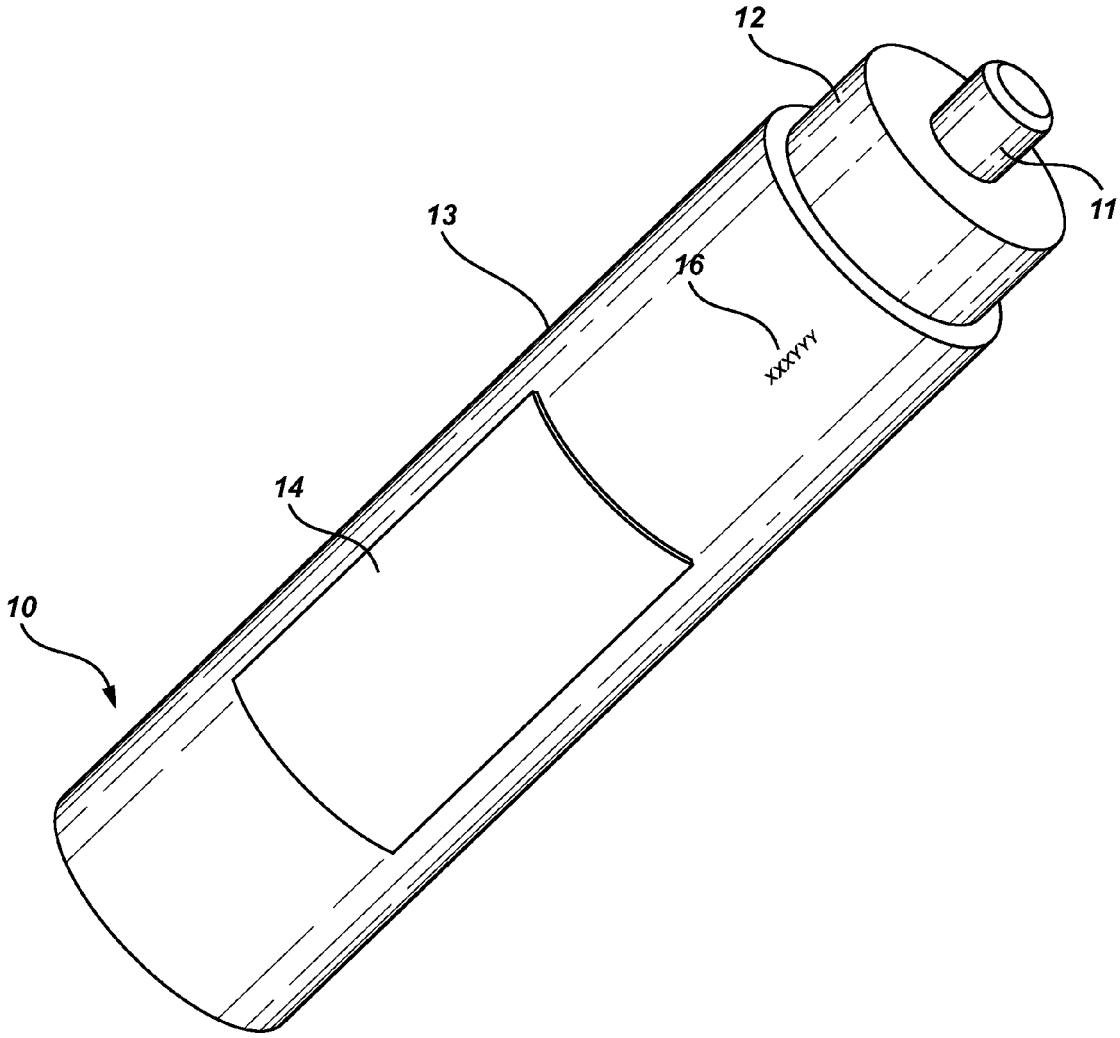
FIG. 1 is a perspective view of a partially assembled sleeve and cylinder.

Referring to FIG. 1, a sleeve and cylinder assembly 10 is shown. For the purpose of definition, a printing cylinder 12 is mounted on mandrel 11 either while in the press, or out of the press. The printing cylinder 12 is also known as build up mandrel or intermediate plate cylinder. The sleeve 13 is mounted to the printing cylinder 12, and the package can be mounted into the press, or assembled on the press. Sleeve 13 is shown in partial assembly to printing cylinder 12 where the sleeve jackets the cylinder. Printing plate 14 is mounted on sleeve 13. An indicia 16 according to a sleeve marking convention 17 is shown on the surface of sleeve 13 at an easily readable location near the edge. The sleeve 13 can also be considered to be a printing sleeve for the purposes of this description, except that a printing plate would not, in this case, be mounted thereto.

Figure 2:
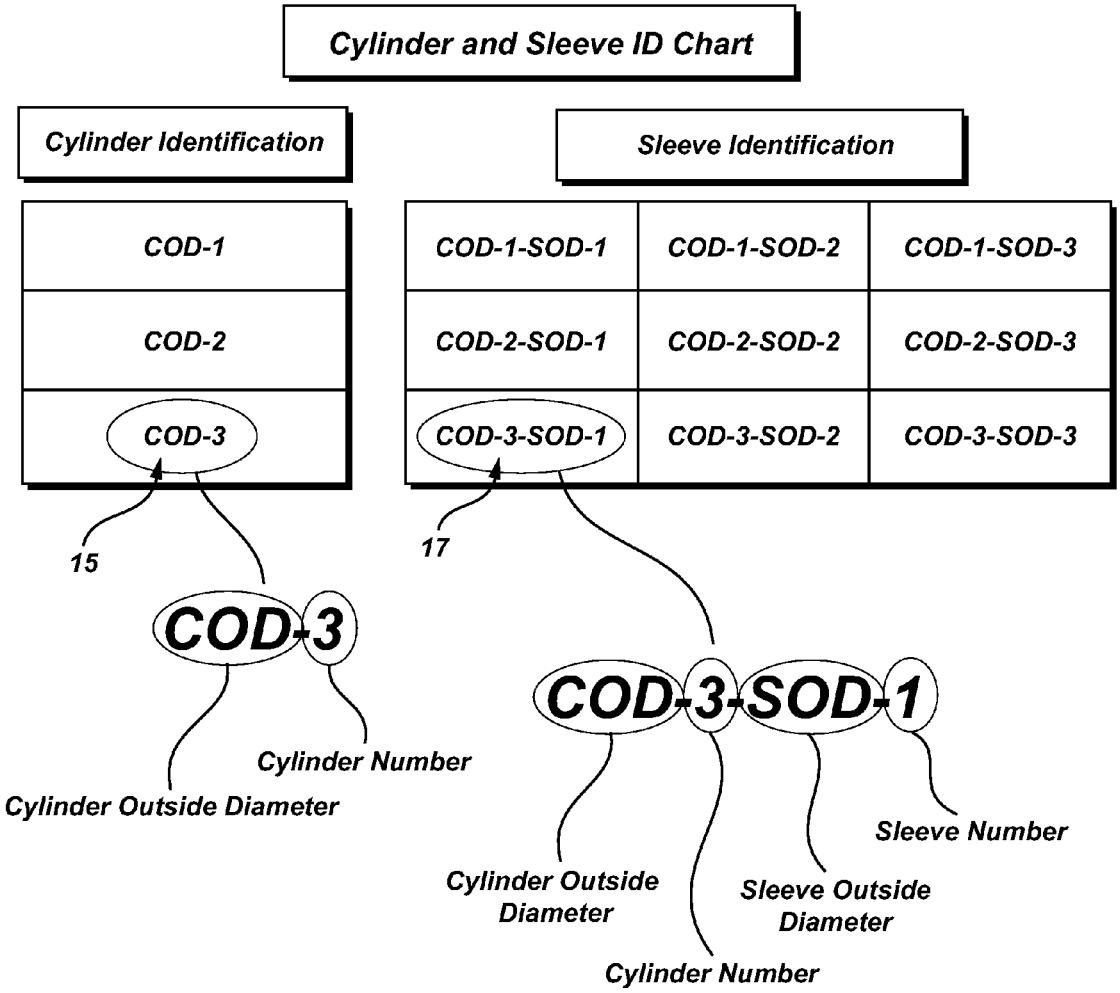
FIG. 2 is a diagram of a sleeve and cylinder marking convention.

Referring to FIG. 2, a cylinder marking convention 15 and a sleeve marking convention 17 are shown. As seen from the cylinder marking convention 15, each cylinder is marked to show two components of information, which include the outside diameter of the cylinder and a number that distinguishes the cylinder from other cylinders of the same diameter. As seen from the sleeve marking convention 17, each sleeve is marked with four components of information. The first two represent the cylinder to which the sleeve is associated. The third number represents the outside diameter of the sleeve and the final number distinguishes the sleeve from other sleeves of the same diameter. The letters "C" and "S", or another appropriate indicia, may precede the diameters to distinguish a cylinder diameter from a sleeve diameter, unless the order of presentation is a part of the convention.

While the above marking convention is exemplary, it is to be considered only one of many within the conceptual framework of the present invention. In fact, any convention which relates the unique codes, symbols, or signatures of a discreet cylinder and a discreet sleeve having a relationship by virtue of customization of the cylinder and sleeve as a unit, is comprehended by this invention. By way of illustration, a convention of the form XXXYYY, where XXX is any sequence of any multiplicity of letters or numbers which uniquely identifies either of the cylinder or the sleeve, and YYY is any sequence of any multiplicity of letters or numbers which uniquely identifies the other of the cylinder and the sleeve, is a convention envisioned by the present invention. The above scheme can be expanded to XXXYYYZZZ, where ZZZ represents a third component, such as a printing plate.

Another illustrative convention is of the form X1X2Y1Y2, where the Xs refer by 1st position to the cylinder and the Ys refer by 2nd position to the sleeve, or visa versa, and X1 and Y1 are letters or numbers uniquely indicating one of several diameters and X2 and Y2 are letters or numbers uniquely indicating one of several cylinders or sleeves of those diameters in a given relationship.

Figure 3:
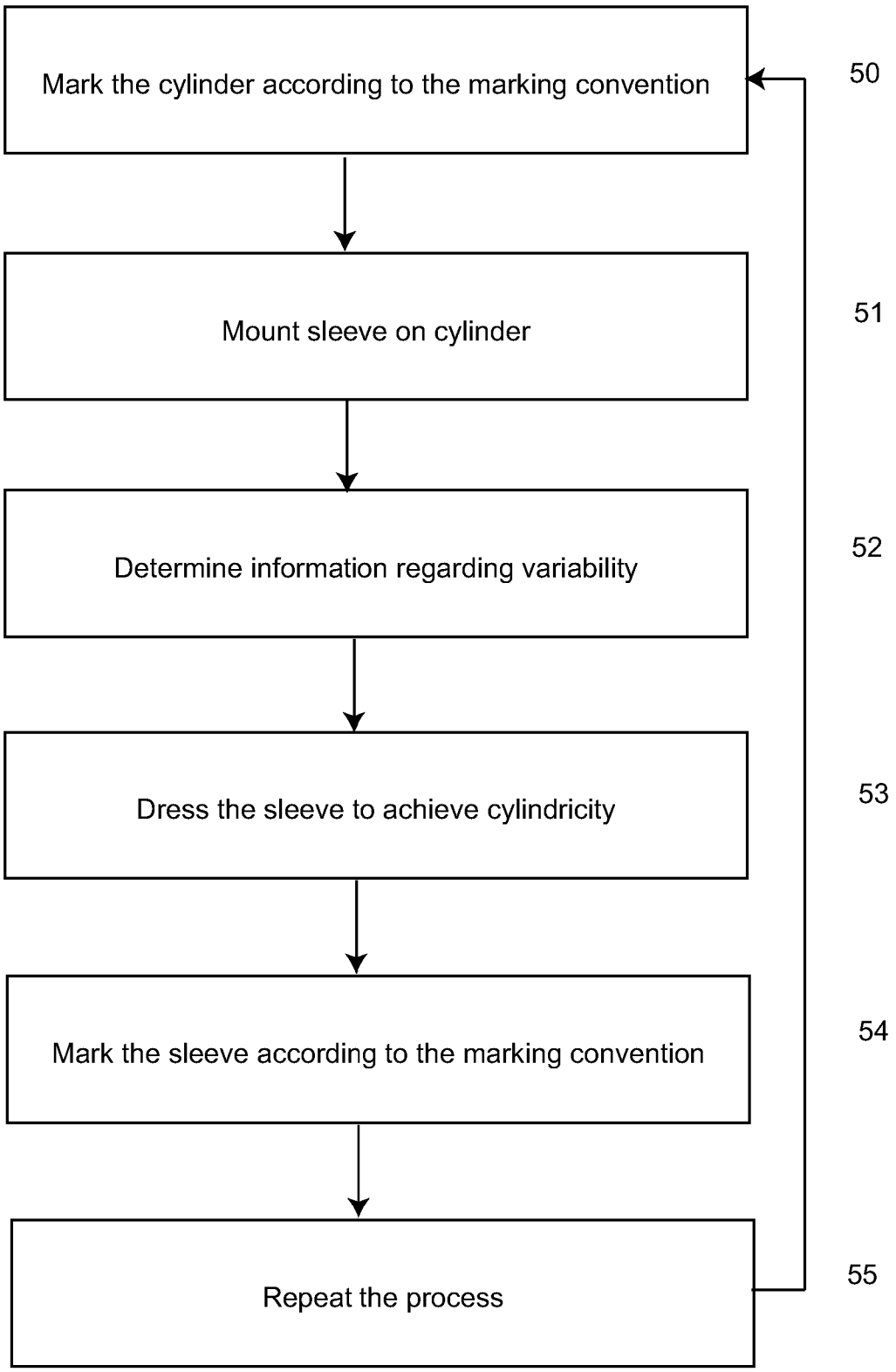
FIG. 3 is a method diagram according to the present invention.

According to a method embodiment of the present invention, as shown in FIG. 3, a printing cylinder 12 and associated sleeves are corrected and marked according to the cylinder marking convention 15 and the sleeve marking convention 17. In step 50, a printing cylinder 12 is selected and marked according to the cylinder marking convention 15 described in FIG. 2. Next, in steps 51-53, the cylinder and sleeve combination are corrected for cylindricity. In step 54, the sleeve is marked according to the sleeve marking convention 17 as shown in FIG. 2. Lastly, in step 55, the process is repeated for each new sleeve and cylinder combination.

It is to be understood that the invention is not limited in its application to the details of construction and to the arrangements of the components set forth in the preceding description or illustrated in the drawings. The invention is capable of other embodiments and of being practiced and carried out in various ways. Also, it is to be understood that the phraseology and terminology employed herein are for the purpose of the description and should not be regarded as limiting.

What is claimed is:

1. A method of indicating a unique match of sleeve and printing cylinder, comprising the steps of:

marking a selected cylinder with a first prescribed convention of the symbolic form of X1X2, wherein the sub-symbol X1 represents any multiplicity of letters or numbers, or combinations thereof, to indicate the outside diameter of said cylinder and the sub-symbol X2 represents any multiplicity of letters or numbers, or combinations thereof, to uniquely indicate the selected one of several cylinders having a common outside diameter;

mounting a selected sleeve onto the cylinder having an inside diameter to fit said cylinder and an outside diameter appropriate to a repeat length of a selected printing plate;

determining information regarding the variability of the total indicated run-out and taper of the sleeved cylinder;

dressing the sleeve to achieve cylindricity based on the variability information;

marking the sleeve with a second prescribed convention of the symbolic form X1X2Y1Y2, wherein X1X2 represents the cylinder marking and the sub-symbol Y1 represents any multiplicity of letters or numbers, or combinations thereof, to indicate the outside diameter of the sleeve and the sub-symbol Y2 represents any multiplicity of letters or numbers, or combinations thereof, to uniquely indicate the selected one of several sleeves having the same general outside diameter and which have also been dressed in accordance with variability information determined while mounted to the same cylinder; and repeating the above steps for each cylinder and sleeve combination in a plurality of cylinder and sleeve combinations.

2. The method of claim 1, wherein the dressing step is by laser ablation.

3. The method of claim 2, wherein the marking step is achieved by laser etching into the sleeve surface at a location proximate to an edge where it would be highly visible.

4. The method of claim 1, wherein the step of marking the sleeve is executed by means selected from the group consisting of chemical etching, mechanical engraving, stenciling and label application.

5. A method of indicating a unique match of sleeve and printing cylinder, comprising the steps of:

marking a selected cylinder with a first prescribed convention of the symbolic form of COD-N1, wherein the sub-symbol COD represents the numerical outside diameter of the cylinder and the sub-symbol N1 represents any multiplicity of letters or numbers, or combinations thereof, to uniquely indicate the selected one of several cylinders having a common outside diameter;

mounting a selected sleeve onto the cylinder having an inside diameter to fit said cylinder and an outside diameter appropriate to a repeat length of a selected printing plate;

determining information regarding the variability of the total indicated run-out and taper of the sleeved cylinder;

dressing the sleeve to achieve cylindricity based on the variability information; marking the sleeve with a second prescribed convention of the symbolic form COD-N1-SOD -N2, wherein COD-N1 represents the cylinder marking and the sub-symbol SOD represents the numerical outside diameter of the sleeve and the sub-symbol N2 represents any multiplicity of letters or numbers, or combinations thereof, to uniquely indicate the selected one of several sleeves having the same general outside diameter and which have also been dressed in accordance with variability information determined while mounted to the same cylinder; and repeating the above steps for each cylinder and sleeve combination in a plurality of cylinder and sleeve combinations.

6. The method of claim 5, wherein the dressing step is by laser ablation.

7. The method of claim 6, wherein the marking step is achieved by laser etching into the sleeve surface at a location proximate to an edge where it would be highly visible.

8. The method of claim 5, wherein the marking step is executed by means selected from the group consisting of chemical etching, mechanical engraving, stenciling and label application.

* * * * *